US009972939B2

(12) United States Patent
Sekino et al.

(10) Patent No.: US 9,972,939 B2
(45) Date of Patent: May 15, 2018

(54) CONNECTOR WITH FITTING DETECTION MEMBER

(71) Applicant: YAZAKI CORPORATION, Tokyo (JP)

(72) Inventors: Tetsuya Sekino, Shizuoka (JP); Nobuyuki Sakamoto, Shizuoka (JP); Toshinori Yamamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/653,823

(22) Filed: Jul. 19, 2017

(65) Prior Publication Data

US 2018/0034206 A1 Feb. 1, 2018

(30) Foreign Application Priority Data

Jul. 29, 2016 (JP) ..... 2016-149205

(51) Int. Cl.

*H01R 13/641* (2006.01)
*H01R 13/639* (2006.01)
*H01R 13/642* (2006.01)
*H01R 13/627* (2006.01)

(52) U.S. Cl.

CPC ..... *H01R 13/639* (2013.01); *H01R 13/6278* (2013.01); *H01R 13/641* (2013.01); *H01R 13/642* (2013.01)

(58) Field of Classification Search

CPC ..... H01R 13/641; H01R 13/642; H01R 13/6272; H01R 13/6278; H01R 13/639

USPC ..... 439/489

See application file for complete search history.

(56) References Cited

U.S. PATENT DOCUMENTS 6,908,329 B2 * 6/2005 Kozono ..... H01R 13/641 439/352
9,563,025 B2 * 2/2017 Yamagata ..... G02B 6/3869
2009/0149054 A1 * 6/2009 Zheng ..... H01R 13/6272 439/357
2018/0034201 A1 * 2/2018 Sekino ..... H01R 13/62
2018/0034210 A1 * 2/2018 Sekino ..... H01R 13/641

FOREIGN PATENT DOCUMENTS

JP 2012-074190 A 4/2012

* cited by examiner

*Primary Examiner* — Michael A Lyons
*Assistant Examiner* — Milagros Jeancharles
(74) *Attorney, Agent, or Firm* — Sughrue Mion, PLLC

(57) ABSTRACT

A second locked part engaged with a second locking part releases a contact between detection protrustion and the second locking part located at a temporary engagement position at which the contact between the detection protrusion and the second locking part prevents a movement of a fitting detection member in a first direction and allows the fitting detection member to move in the first direction. A deflection regulator of the fitting detection member located at a complete engagement position at which a first locked part is engaged with a first locking part regulates a deflection amount of a fitting lock arm within a range in which an engagement between the second locking part and the second locked part is unreleasable while an engagement between the first locking part and the first locked part is releasable.

5 Claims, 17 Drawing Sheets

CONNECTOR WITH FITTING DETECTION MEMBER

CROSS REFERENCE TO RELATED APPLICATION

This application is based upon and claims the benefit of priority from the prior Japanese Patent Application No. 2016-149205, filed on Jul. 29, 2016, the entire contents of which are incorporated herein by reference.

BACKGROUND

1. Technical Field

The disclosure relates to a connector, and more particularly, to a connector including a first housing capable of housing a terminal; a second housing capable of housing a mating terminal; and a fitting detection member capable of detecting a fitted state between the first housing and the second housing.

2. Related Art

Conventionally, a connector including a fitting detection member has been proposed. For example, one (hereinafter, referred to as an 'conventional connector') of the conventional connectors includes a male housing capable of housing a male terminal, a female housing capable of housing a female terminal, and a fitting detection member capable of detecting engagement (i.e., fitting of the connector) between a fitting lock arm extended from the female housing and a fitting protrusion protruding from the male housing. The conventional connector has a structure in which a protrusive piece-shaped regulator extended from the fitting detection member is located at a position interfering with the fitting lock arm to prevent the fitting between the fitting lock arm and the fitting protrusion from being unintentionally released (prevent the fitting lock arm from being far away from the fitting protrusion). JP 2012-74190 A proposes such a connector.

SUMMARY

The conventional connector has a structure in which the fitting detection member can be separated from the housing by purling the fitting detection member toward a rear of a fitted direction with a force larger than a predetermined engagement force in consideration of workability or the like when the fitting is intentionally released.

For this reason, the conventional connector is excellent in workability when the fitting is released, but has a problem in that the fitting detection member may be unintentionally separated from the housing when excessively large external forces (impact, vibration and the like exceeding the engagement force) are applied to the fitting detection member. Even if the fitting detection member is unintentionally separated in this way, a fitted state of the connector is maintained by an elastic force of the fitting lock arm, such that the fitting of the connector is not directly released. However, if the external force is applied to the fitting lock arm in the state in which the fitting detection member is separated, the fitting lock arm is deflected, such that the fitting of the connector may be released.

For this reason, countermeasures such as devising a location of the conventional connector so as not to apply the external force to the fitting detection member well may be required depending on an use environment of the conventional connector. As a result, it has become difficult to improve the workability when the conventional connector is used.

An object of the present disclosure is to provide a connector in which a fitted state of the connector can be detected and unintentional release of fitting of the connector can be prevented.

A connector in accordance with some embodiments includes: a first housing configured to house a terminal; a second housing configured to house a mating terminal and fittable with the first housing; and a fitting detection member mounted from a rear of the first housing in a first direction in which the first housing approaches the second housing in a fitted direction between the first housing and the second housing, the fitting detection member being configured to detect a fitted state between the first housing and the second housing. The first housing includes: a fitting lock arm extending toward a second direction opposite to the first direction; a first locking part provided in the fitting lock arm and engageable with the fitting detection member; and a second locking part provided in the fitting lock arm and engageable with the second housing. The fitting detection member includes: a detection lock arm extending toward the first direction; a detection protrusion provided in the detection lock arm; a deflection regulator configured to regulate a deflection amount of the fitting lock arm; and a first locked part engageable with the first locking part. The second housing includes a second to part engageable with the second locking part. The fitting detection member is movable between a temporary engagement position and a complete engagement position, the temporary engagement position at which a contact between the detection protrusion and the second locking part prevents a movement of the fitting detection member in the first direction, the complete engagement position to which the fitting detection member moves from the temporary engagement position in the first direction and at which the first locked part is engaged with the first locking part. The second locked part engaged with the second locking part releases the contact between the detection protrusion and the second locking part located at the temporary engagement position and allows the fitting detection member to move in the first direction. The deflection regulator of the fitting detection member located at the complete engagement position regulates the deflection amount of the fitting lock arm within a range in which an engagement between the second locking part and the second locked part is unreleasable while an engagement between the first locking part and the first locked part is releasable.

According to the above configuration, when the connector is fitted, if the fitting detection member approaches a second housing in a state in which the fitting detection member is at a temporary engagement position (position at which forward movement of the fitting detection member is prevented), a first housing also approaches the second housing along with the fitting detection member, such that the first housing and the second housing are fitted with each other. Further, of the contact between the detection protrusion and the second locking part is released according to the fitting, such that the fitting detection member can move forward. For this reason, a fitted state between the first housing and the second housing can be detected depending on a position of the fitting detection member (in detail, whether the fitting detection member is at the temporary engagement position or whether the fitting detection member moves forward from the temporary engagement position).

Further, when the fitting detection member is at a complete engagement position (position at which the fitting detection member and the first housing are engaged with each other), a deflection amount of the fitting lock arm is regulated by a deflection regulator so as to be in a range in which engagement of the first locking part can be released but engagement of the second locking part cannot be released. For this reason, when the fitting is intentionally released, the fitting lock arm is deflected to release engagement between the fitting detection member and the first housing (engagement between the first locking part and a first locked part), and then move the fitting detection member from the complete engagement position toward the temporary engagement position, and the fitting lock arm is deflected to release engagement between the first housing and the second housing (engagement between the second locking part and a second locked part). In other words, when the fitting of the connector is released, two operations of releasing (first releasing) the engagement between the fitting detection member and the first housing and releasing (second releasing) the engagement between the first housing and the second housing are performed. Therefore, in the connector having the above configuration, the unintentional release of the fitting of the connector can be more certainly prevented as compared with the conventional connector.

As a result, according to the above configuration, the fitted state of the connector can be detected and the unintentional release of the fitting can be prevented.

By the way, the "first direction" (front in the fitted direction) refers to a direction in which the first housing moves (approaches the second housing) when the first housing engages with the second housing. Meanwhile, the "second direction" (rear in the fitted direction) refers to a direction in which the first housing moves (becomes far away from the second housing) when the engagement between the first housing and the second housing is released. The same goes for the fitting detection member and the second housing.

A deflection direction of the fitting lock arm for releasing the engagement between the first locking part and the first locked part and a deflection direction of the fitting lock arm for releasing the engagement between the second locking part and the second locked part may be a same direction, and the deflection regulator of the fitting detection member located at the complete engagement position may interfere with the fitting lock arm deflected in the same direction.

According to the above configuration, the deflection direction of the fitting lock arm for releasing the engagement of the first locking part and the deflection direction of the fitting lock arm for releasing the engagement of the second locking part are the same as each other. For this reason, when the fitting is released, a series of operations of performing the above-mentioned first releasing, movement of the fitting detection member toward the temporary engagement position, and the above-mentioned second releasing can be continuously performed just like a single operation. Therefore, in the connector having the above configuration, the unintentional release of the fitting of the connector can be prevented, and the fitting of the connector can be easily released when the fitting of the connector is intentionally released.

A deflection direction of the fitting lock arm for releasing the engagement between the first locking part and the first locked part and a deflection direction of the fitting lock arm for releasing the engagement between the second locking part and the second locked part may be opposite to each other, and the deflection regulator of the fitting detection member located at the complete engagement position may interfere with the fitting lock arm deflected in the deflection direction for releasing the engagement between the second locking part and the second locked part.

According to the above configuration, the deflection direction of the fitting lock arm for releasing the engagement of the first locking part and the deflection direction of the fitting lock arm for releasing the engagement of the second locking part are opposite to each other. For this reason, when the fitting is released, the fitting lock arm is deflected toward the former direction to move the fitting detection member toward the temporary engagement position simultaneously with performing the first releasing, and the fitting lock arm is then deflected toward the latter direction to perform the second releasing. That is, a series of operations of releasing the fitting are performed while changing the deflection direction of the fitting lock arm. Therefore, in the connector having the above configuration, an operation of releasing the fitting of the connector is somewhat complicated, but unintentional release of the fitting of the connector can be more certainly prevented due to the complicated operation.

The fitting detection member may be inserted onto the first housing.

According to the above configuration, since the fitting detection member is inserted onto the first housing, if an operator who fits the connector approaches the fitting detection member to the second housing only by holding the fitting detection member (i.e., without holding the first housing), detection of the fitted state and engagement between the fitting detection member and the first housing may be performed continuously as a series of operations. Therefore, the connector having the present configuration can more easily be fitted since it is unnecessary for the operator to change the fitting detection member, as compared with a case in which the fitting detection member is inserted into the first housing and the like.

The first locking part may be located at an end of a free end side of the fitting lock arm, and the second locking part may be located at a position closer to a fixed end than the first locking part of the fitting lock arm.

According to the above configuration, the first locking part is provided at an end of a free end side of the fitting lock arm, and the second locking part is provided at a position closer to the fixed end than the first locking part. For this reason, when the fitting lock arm is deflected around the fixed end, a movement amount of the first locking part becomes larger than that of the second locking part. As a result, it is possible to easily regulate the deflection amount by the deflection regulator by adjusting a length of the fitting lock arm, locations of the first locking part and the second locking part, a location of the deflection regulator and the like.

DETAILED DESCRIPTION

Figure 1:
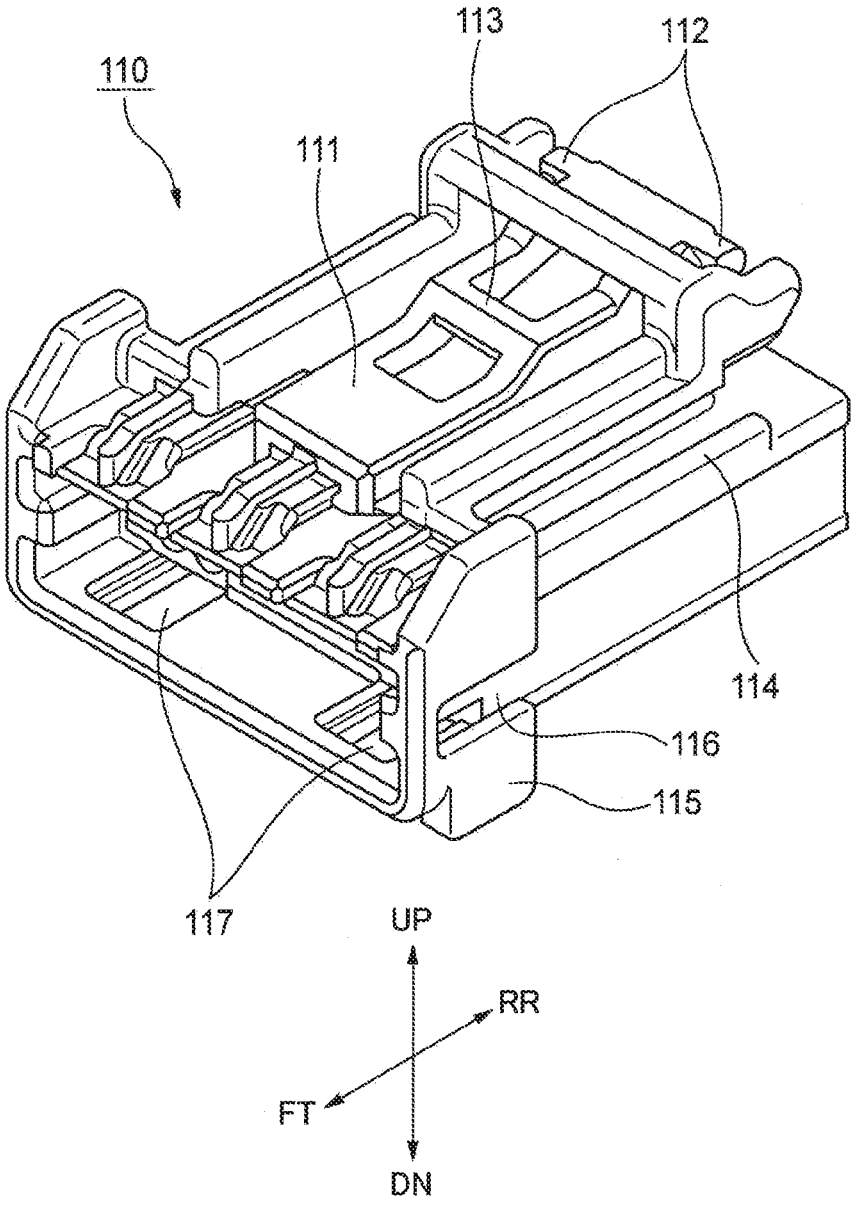
FIG. 1 is a schematic perspective view of a female housing according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Hereinafter, a connector 100 according to a first embodiment of the present disclosure will be described with reference to FIGS. 1 to 10B.

Structure of Connector

As illustrated in FIGS. 1 to 10B (particularly, FIGS. 5A and 5B), the connector 100 includes a female housing (first housing) 110, a fitting detection member 120, and a male housing (second housing) 130.

In FIGS. 1 to 10B, a direction in which the female housing 110 faces the male housing 130 is referred to as a front in a fitted direction, a direction opposite to the front is referred to as a rear in the fitted direction, and a height direction of the female housing 110 orthogonal to front and rear directions is referred to as a vertical direction. The same goes for front and rear directions and vertical directions of the fitting detection member 120 and the male housing 130. It should be noted that, in FIGS. 1 to 4, an up direction, a down direction, a front direction, and a rear direction are denoted by UP, DN, FT, and RR, respectively.

As illustrated in FIG. 1, the female housing 110 has a tubular shape having openings formed at the front and the rear in the fitted direction. The female housing 110 has a fitting lock arm 111 extended toward the rear in the fitted direction. The fitting lock arm 111 has a cantilevered shape having a fixed end formed at the front in the fitted direction and a free end formed at the rear in the fitted direction. The female housing 110 includes fitting detection member engaging parts (first locking parts) 112 provided at an end of a free end side (rear side) of the fitting lock arm 111 and a male housing engaging part (second locking part) 113 provided at a fixed end side from the fitting detection member engaging parts 112.

The fitting detection member engaging part 112 is a member (protruding member) that can be engaged with the fitting detection member 120 when the connector 100 is fitted, and the male housing engaging part 113 is a member (pillar-shaped member) that can be engaged with the male housing 130 when the connector 100 is fitted.

Furthermore, side walls of the female housing 110 are provided with guide rails 114 for slidably mounting the fitting detection member 120 and abutting walls 115 onto which the fitting detection member 120 abuts (i.e. with which the fitting detection member 120 is in contact) when the fitting detection member 120 is at a complete engagement position. The abutting walls 115 are provided with side wall groove portions 116. A lower wall of the female housing 110 is provided with lower wall groove portions 117.

Figure 2:
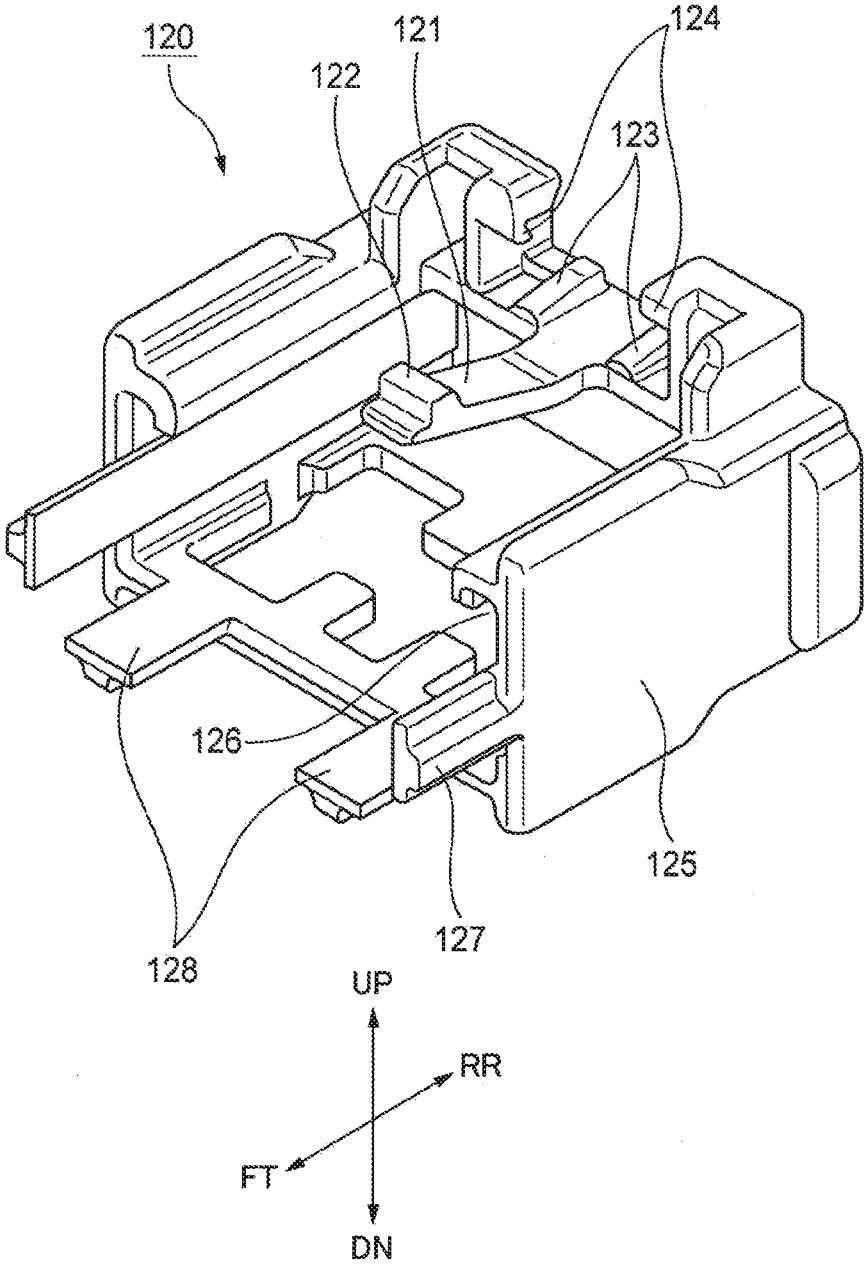
FIG. 2 is a schematic perspective view of a fitting detection member according to the first embodiment.

As illustrated in FIG. 2, the fitting detection member 120 has a ring shape circulated around an axial line in the fitted direction (front and rear directions). The fitting detection member 120 has a detection lock arm 121 extended toward the front in the fitted direction. The detection lock arm 121 has a cantilevered shape having a fixed end formed at the rear in the fitted direction and a free end formed at the front in the fitted direction. The fitting detection member 120 includes a detection protrusion 122 provided near the free end of the detection lock arm 121, deflection regulators 123 capable of regulating a deflection amount of the fitting lock arm 111, and engaging parts (first locked parts) 124 corresponding to the fitting detection member engaging parts 112 of the female housing 110.

Further, side walls of the fitting detection member 120 are provided with abutting walls 125 abutting onto the abutting walls 115 of the female housing 110 when the fitting detection member 120 is at the complete engagement position, insertion holes 126 into which the guide rails 114 of the female housing 110 are inserted, and side wall protrusions 127 inserted into the side wall groove portions 116 of the abutting walls 115 of the female housing 110. A lower wall of the fitting detection member 120 is provided with lower wall protrusions 129 inserted into the lower wall groove portions 117 of the female housing 110.

Figure 3:
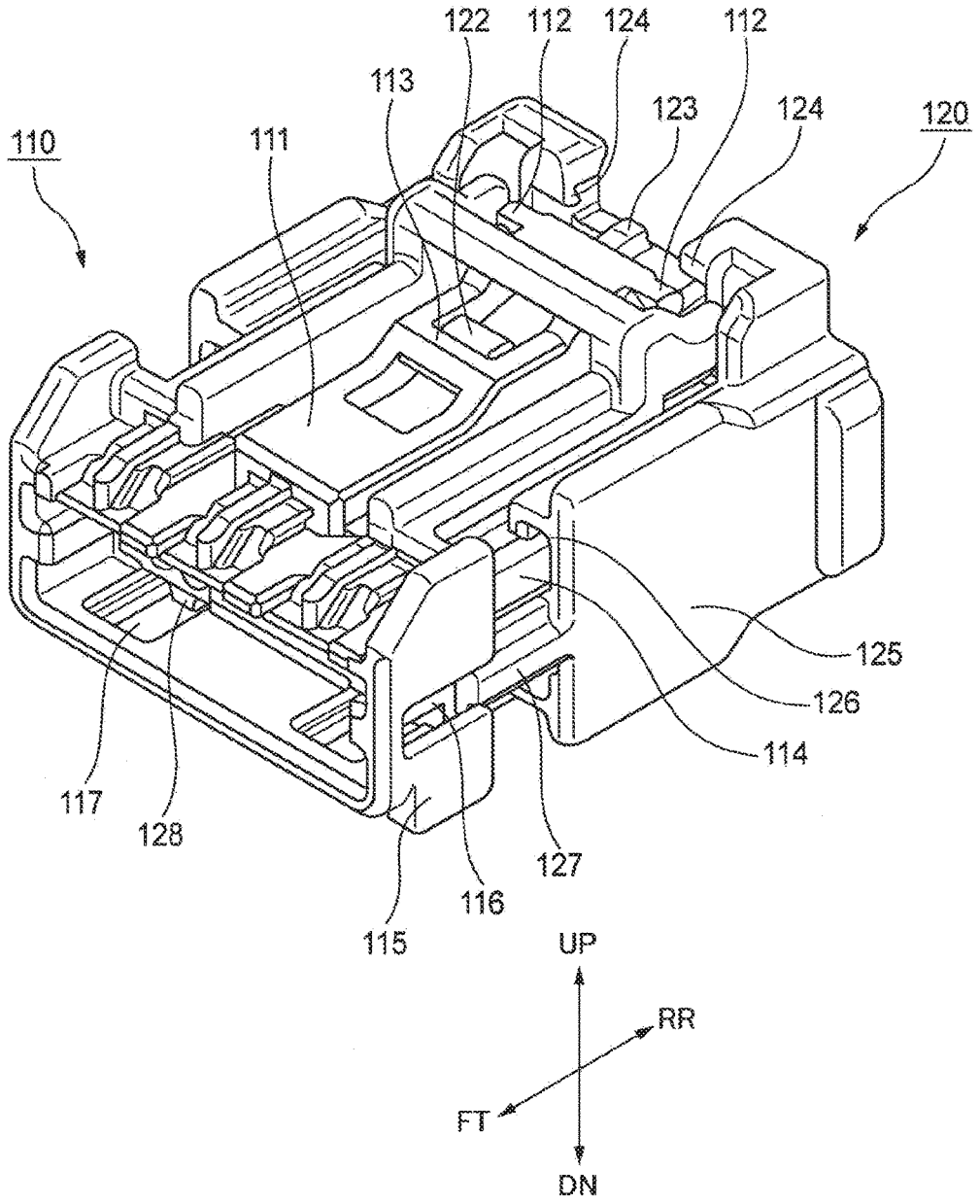
FIG. 3 is a schematic perspective view of a case in which the fitting detection member of FIG. 2 is mounted to the female housing of FIG. 1 (a case in which the fitting detection member is at a temporary engagement position).

As illustrated in FIG. 3, the fitting detection member 120 is mounted to the female housing 110 so as to be inserted onto the female housing 110 (or inserted on the exterior of the female housing 110) from a rear of the female housing 110. In FIG. 3, the detection protrusion 122 of the fitting detection member 120 abuts onto a rear wall surface of the male housing engaging part 113 of the female housing 110, such that a forward movement of the fitting detection member 120 is restricted. In other words, when the fitting detection member 120 is pushed forward in a state illustrated in FIG. 3, the fitting detection member 120 does not move forward (does not relatively move with respect to the female housing 110), but the female housing 110 itself moves forward.

If the fitting detection member 120 is at a position illustrated in FIG. 3, the fitting detection member engaging parts 112 of the female housing 110 and the engaging parts 124 of the fitting detection member 120 are separated from each other, and are not engaged with each other. In other words, the fitting detection member 120 is temporarily engaged with the female housing 110. Therefore, the position of the fitting detection member 120 illustrated in FIG. 3 is also referred to as a temporary engagement position.

Further, if the fitting detection member 120 is at the temporary engagement position as described above, the guide rails 114 of the female housing 110 are inserted into the insertion holes 126 of the sidewalls of the fitting detection member 120, distal ends of the side wall protrusions 127 of the fitting detection member 120 are inserted into the side wall groove portions 116 of the female housing 110, and distal ends of the lower wall protrusions 128 of the fitting detection member 120 are inserted into the lower wall groove portions 117 of the female housing 110. Therefore, even when the fitting detection member 120 is at the temporary engagement position, a displacement (wobble) between the female housing 110 and the fitting detection member 120 is suppressed.

In this case, the abutting walls 125 of the fitting detection member 120 do not abut onto the abutting walls 115 of the female housing 110. The abutting walls 125 of the fitting detection member 120 and the abutting walls 115 of the female housing 110 abut onto each other when the fitting detection member 120 moves to the complete engagement position (for example, see FIGS. 8A and 8B).

Figure 4:
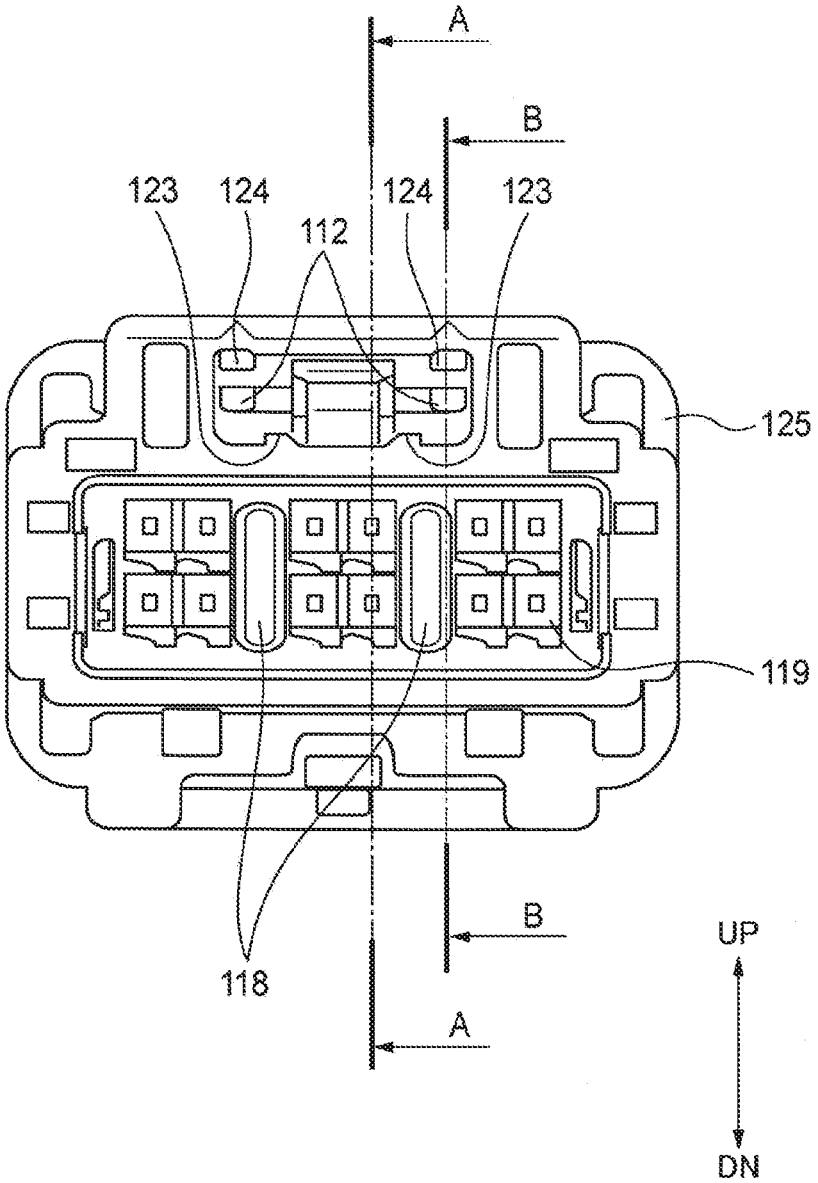
FIG. 4 is a rear view of the female housing and the fitting detection member of FIG. 3 viewed from a rear in a fitted direction.

As illustrated in FIG. 4, the female housing 110 has inner walls 118 that connect a lower wall and an upper wall thereof to each other, and has a plurality of terminal housing chambers 119 within areas (three areas in the present example) divided by the inner walls 118. It should be noted that FIG. 4 illustrates a state in which the terminal housing chambers 119 do not house terminals for convenience of explanation.

Fitting of Connector

Next, procedures of fitting the connector 100 will be described with reference to FIGS. 5A to 8B.

Figure 5A:
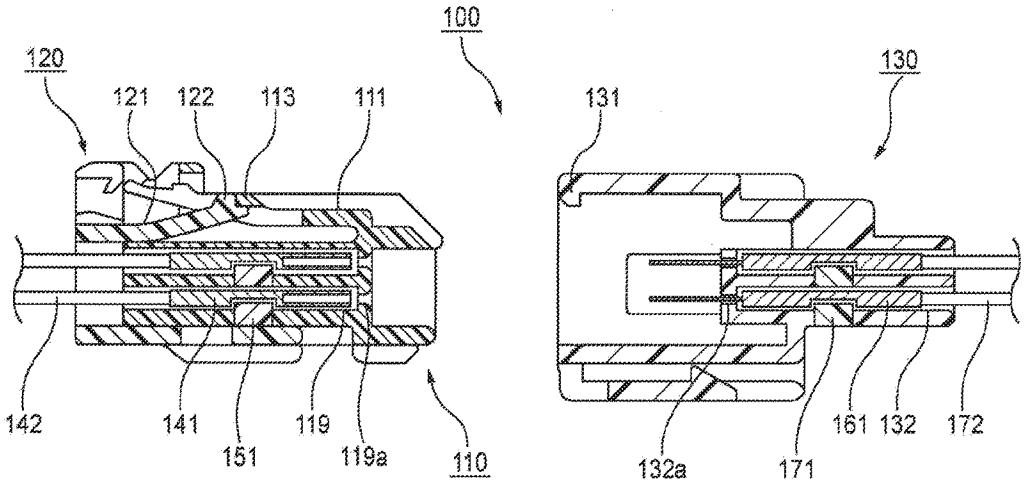
FIG. 5A is a cross-sectional view of the female housing and the fitting detection member, and a male housing according to the first embodiment in a state before the female housing and the fitting detection member are fitted with the male housing (a state in which the female housing and the fitting detection member are separated from the male housing) taken along line A-A of FIG. 4.
Figure 5B:
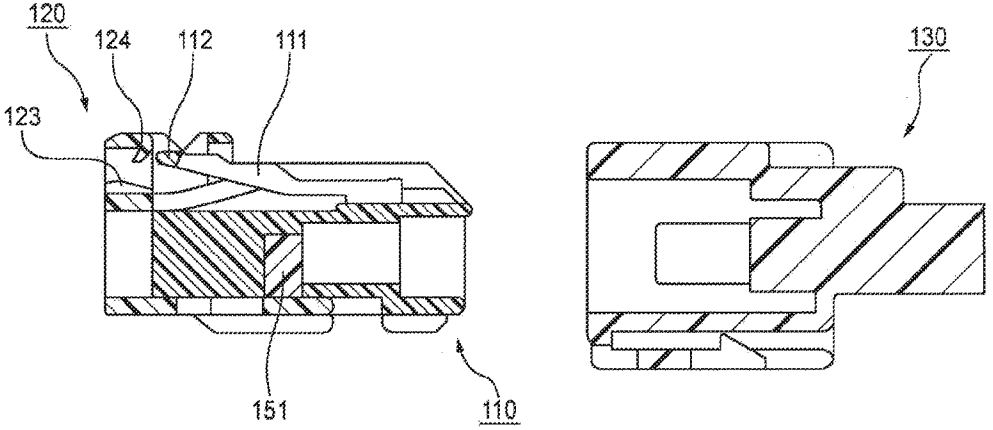
FIG. 5B is a cross-sectional view of the female housing and the fitting detection member, and the male housing according to the first embodiment in the state before the female housing and the fitting detection member are fitted with the male housing (the state in which the female housing and the fitting detection member are separated from the male housing), taken along line B-B of FIG. 4.

First, as illustrated in FIG. 5A, at a point in time before the fitting of the connector 100 starts, the female housing 110 (see FIG. 3) onto which the fitting detection member 120 is inserted from the rear is separated from the male housing 130. The male housing 130 has an engaging part (second locked part) 131 corresponding to the male housing engaging part 113 of the female housing 110 and terminal housing chambers 132. At this point in time, the detection protrusion 122 of the fitting detection member 120 abuts onto the rear wall surface of the male housing engaging part 113 of the female housing 110, such that the relative forward movement of the fitting detection member 120 with respect to the female housing 110 is prevented. Further, as illustrated in FIG. 5B, at this point in time, the fitting detection member engaging part 112 of the female housing 110 and the engaging part 124 of the fitting detection member 120 are spaced from each other.

At this point, female terminals 141 housed in the terminal housing chambers 119 of the female housing 110 are separated from male terminals 161 housed in the terminal housing chambers 132 of the male housing 130. Further, the female terminals 141 are engaged by spacers 151 (and lances (not illustrated) or the like), and the male terminals 161 are engaged by spacers 171 (and lances (not illustrated) or the like). Electric wires 142 are extended behind the female terminals 141, and electric wires 172 are extended behind the male terminals 161.

Figure 6A:
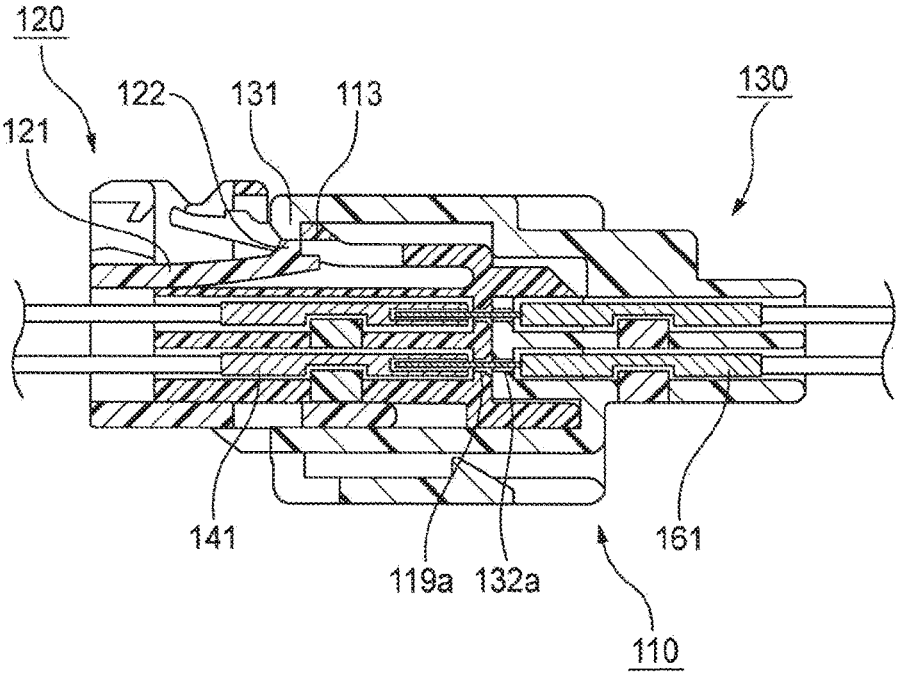
FIG. 6A is a cross-sectional view of the female housing and the fitting detection member, and the male housing in a state while the female housing and the fitting detection member are fitted with the male housing (a state in which the female housing is fitted with the male housing), taken along line A-A of FIG. 4.

Next, as illustrated in FIG. 6A, if the fitting of the connector 100 starts, the female housing 110 to which the fitting detection member 120 is mounted is inserted into the male housing 130. In detail, if an operator pushes the fitting detection member 120 toward the male housing 130, the relative forward movement of the fitting detection member 120 with respect to the female housing 110 is prevented, such that the female housing 110 (and the fitting detection member 120) approaches the male housing 130.

At this time, since a front wall surface of the male housing engaging part 113 of the female housing 110 is inclined with respect to the fitted direction, the engaging part 131 of the male housing 130 is seated on the male housing engaging part 113 and then climbs over the male housing engaging part 113. As a result, the engaging part 131 of the male housing 130 is engaged with the male housing engaging part 113. Further, at this time, the detection protrusion 122 of the fitting detection member 120 is pressed down by the engaging part 131. The detection lock arm 121 is deflected downward by the detection protrusion 122 pressed down as described above. It should be rioted that FIG. 6A illustrates an arrangement of the male housing engaging part 113, the detection protrusion 122, and the engaging part 131 at this point in time.

At this point in time, distal ends of the male terminals 161 protruding from terminal protruding holes 132*a* of the male housing 130 pass through terminal insertion holes 119*a* in the female housing 110 and are then inserted into the female terminals 141. Therefore, the female terminals 141 and the male terminals 161 are electrically connected to each other. In addition, at this point in time, an inner wall surface of the female housing 110 provided with the terminal inserting holes 119*a* and an inner wall surface of the male housing 130 provided with the terminal protruding holes 132*a* abut onto each other. As a result, the female housing 110 and the male housing 130 can no longer approach each other.

Figure 6B:
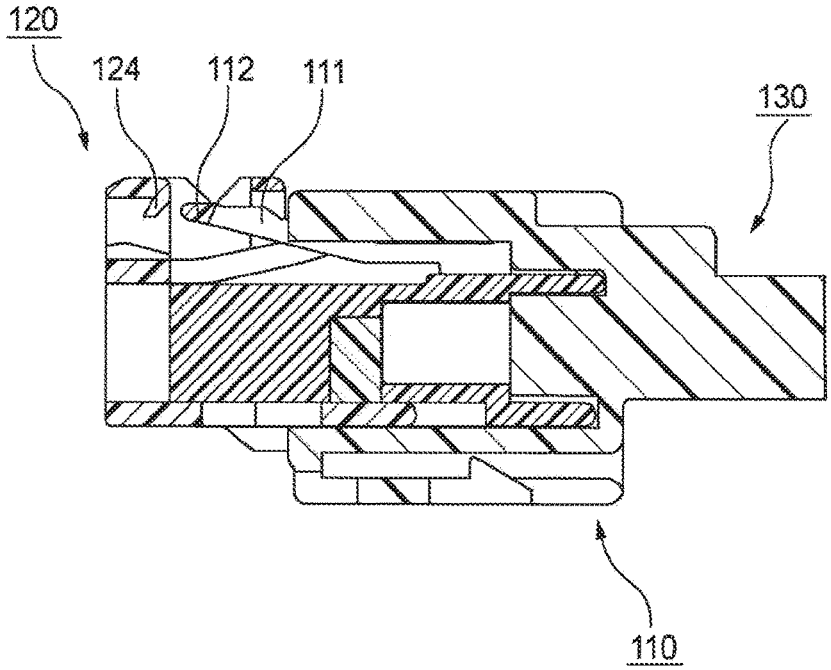
FIG. 6B is a cross-sectional view of the female housing and the fitting detection member, and the male housing in the state while the female housing and the fitting detection member are fitted with the male housing (the state in which the female housing is fitted with the male housing), taken along line B-B of FIG. 4.

Meanwhile, as illustrated in FIG. 6B, at this point in time, the fitting detection member engaging part 112 of the female housing 110 and the engaging part 124 of the fitting detection member 120 are separated from each other, and are not engaged with each other.

Figure 7A:
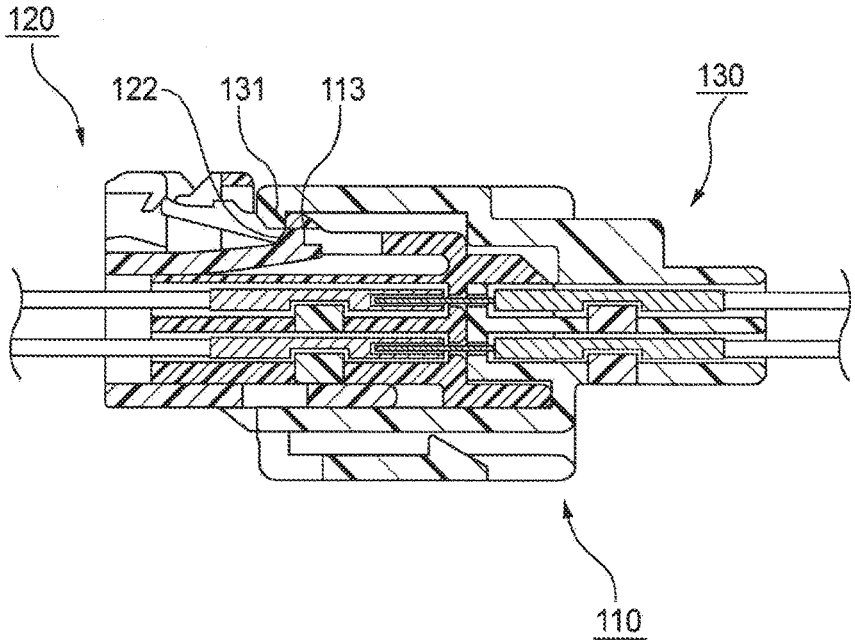
FIG. 7A is a cross-sectional view of the female housing and the fitting detection member, and the male housing in a state while the female housing and the fitting detection member are fitted with the male housing (while the fitting detection member moves to a complete engagement position), taken along line A-A of FIG. 4.
Figure 7B:
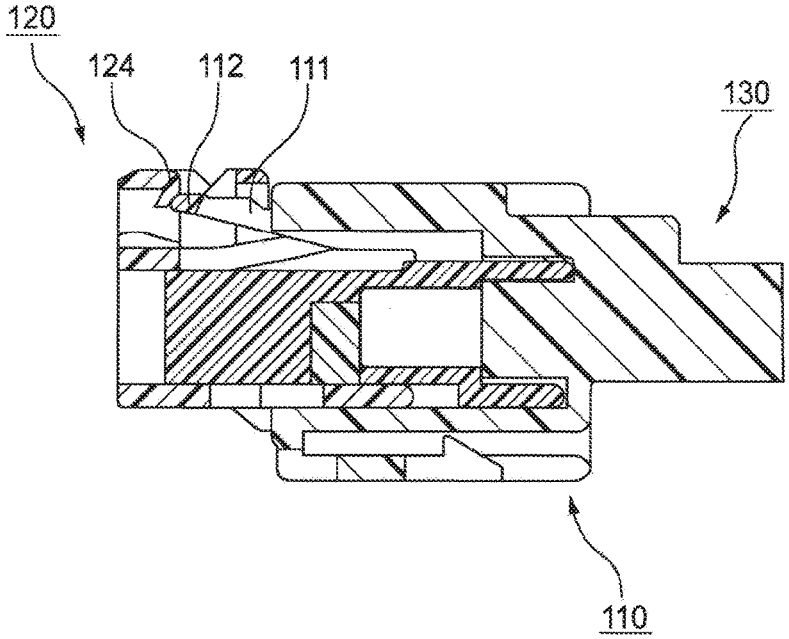
FIG. 7B s cross-sectional view of the female housing and the fitting detection member, and the male housing in the state while the female housing and the fitting detection member are fitted with the male housing (while the fitting detection member moves to the complete engagement position), taken along line B-B of FIG. 4.

Next, as illustrated in FIG. 7A, if the fitting detection member 120 in a state of FIG. 6A is further pushed toward the male housing 130, the detection protrusion 122 of the fitting detection member 120 passes under the male housing engaging part 113 and then moves toward the male housing 130. As a result, the entire fitting detection member 120 approaches the male housing 130. Meanwhile, even if the fitting detection member 120 moves in this way, the female housing 110 cannot move forward as described above. For this reason, at this point in time, as illustrated in FIG. 7B, the engaging part 124 of the fitting detection member 120 and the fitting detection member engaging part 112 of the female housing 110 come into contact with each other. Since a rear wall surface of the fitting detection member engaging part 112 is inclined with respect to the fitted direction and a front wall surface of the engaging part 124 is also inclined with respect to the fitted direction, the fitting lock arm 111 is guided to the inclined surfaces and thus starts to be deflected downward.

Figure 8A:
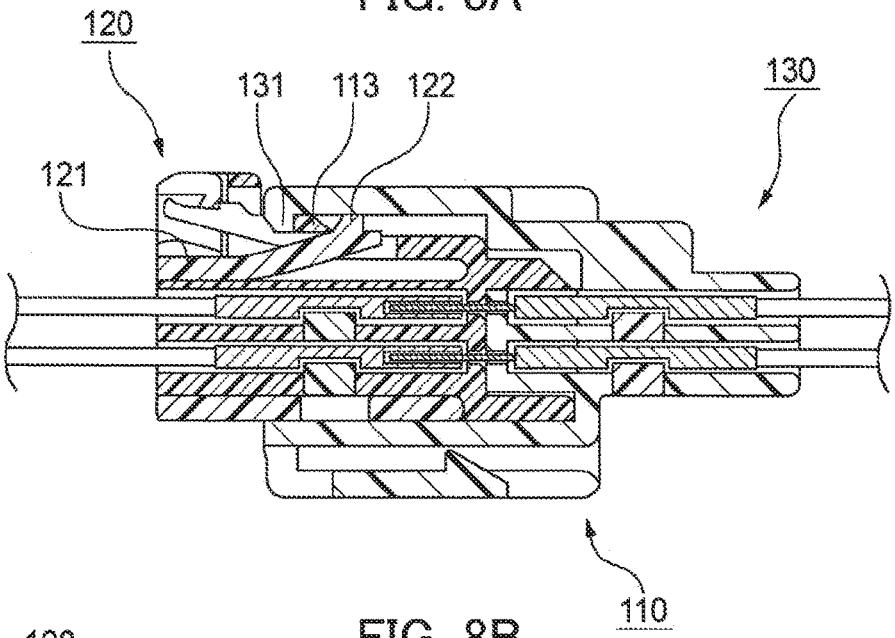
FIG. 8A is a cross-sectional view of the female housing and the fitting detection member, and the male housing in a state in which fitting of the female housing and the fitting detection member with the male housing is completed (a state in which the fitting detection member is at the complete engagement position), taken along line A-A of FIG. 4.

Next, as illustrated in FIG. 8A, if the fitting detection member 120 in a state of FIG. 7A is further pushed toward the male housing 130, the detection protrusion 122 of the fitting detection member 120 passes under the male housing engaging part 113 of the female housing 110 and then moves to the front of the male housing engaging part 113 to be thus engaged with the male housing engaging part 113. Further, as illustrated in FIG. 8B, at this point in time, the fitting detection member engaging part 112 of the female housing 110 and the engaging part 124 of the fitting detection member 120 are engaged with each other.

At this point in time, the abutting walls 125 of the fitting detection member 120 abut onto the abutting walls 115 (see FIG. 3) of the female housing 110. Therefore, the fitting detection member 120 cannot move forward beyond this position.

Figure 8B:
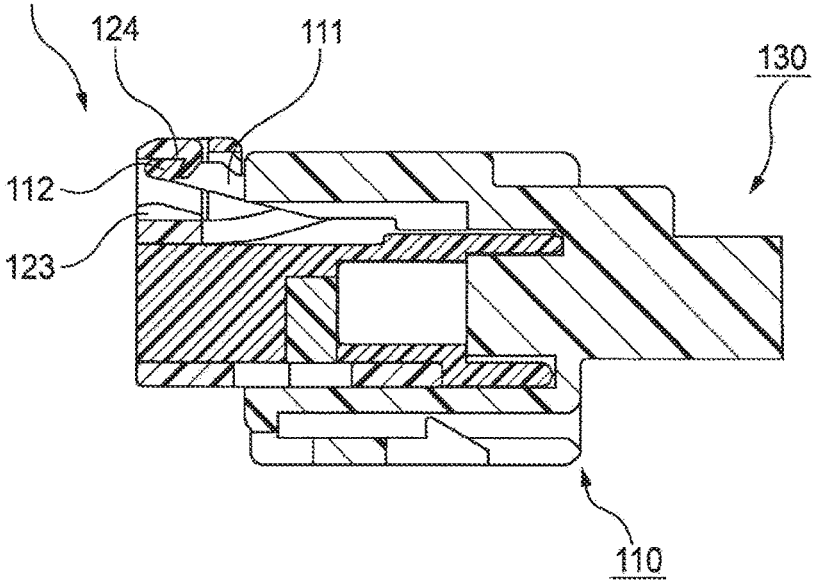
FIG. 8B is a cross-sectional view of the female housing and the fitting detection member, and the male housing in the state in which the fitting of the female housing and the fitting detection member with the male housing is completed (the state in which the fitting detection member is at the complete engagement position), taken along line B-B of FIG. 4.

If the fitting detection member 120 is at a position illustrated in FIGS. 8A and 8B, the fitting detection member engaging part 112 of the female housing 130 and the engaging part 124 of the fitting detection member 120 are engaged with each other. Therefore, in this case, the fitting detection member 120 cannot move rearward, such that fitting detection member 120 and the female housing 110 cannot be separated from each other. In other words, the fitting detection member 120 is in a state in which it is completely engaged with the female housing 110. Therefore, the position of the fitting detection member 120 illustrated in FIGS. 8A and 8B is also referred to as a "complete engagement position".

As described above, the fitting of the female housing 110 with the male housing 130 starts in a state in which the fitting detection member 120 is in the temporary engagement position, and the fitting detection member 120 reaches the complete engagement position by the fitting of the female housing 110 with the male housing 130 (electrical connection between the female terminals 141 and the male terminals 161). At this point, the fitting of the connector 100 is completed. Accordingly, the connector 100 can detect a fitted state (further forward movement from the temporary engagement position) and perform the engagement of the fitting detection member 120 (engagement at the complete engagement position) only by pushing the fitting detection member 120 toward the male housing 130.

Release of Fitting of Connector

Next, procedures of releasing the fitting of the connector 100 (separating the female housing 110 from the male housing 130 to release the electrical connection between the female terminals 141 and the male terminals 161) will be described with reference to FIGS. 9A to 10B.

Figure 9A:
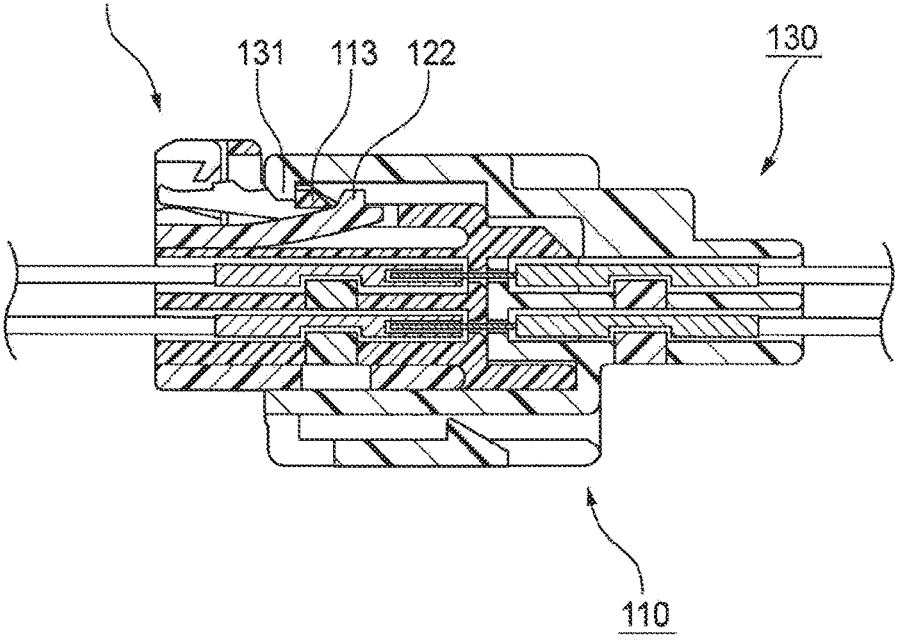
FIG. 9A is a cross-sectional view of the female housing and the fitting detection member, and the male housing in a state while the fitting is released (a state in which engagement between the fitting detection member and the female housing is released), taken along line A-A of FIG. 4.
Figure 9B:
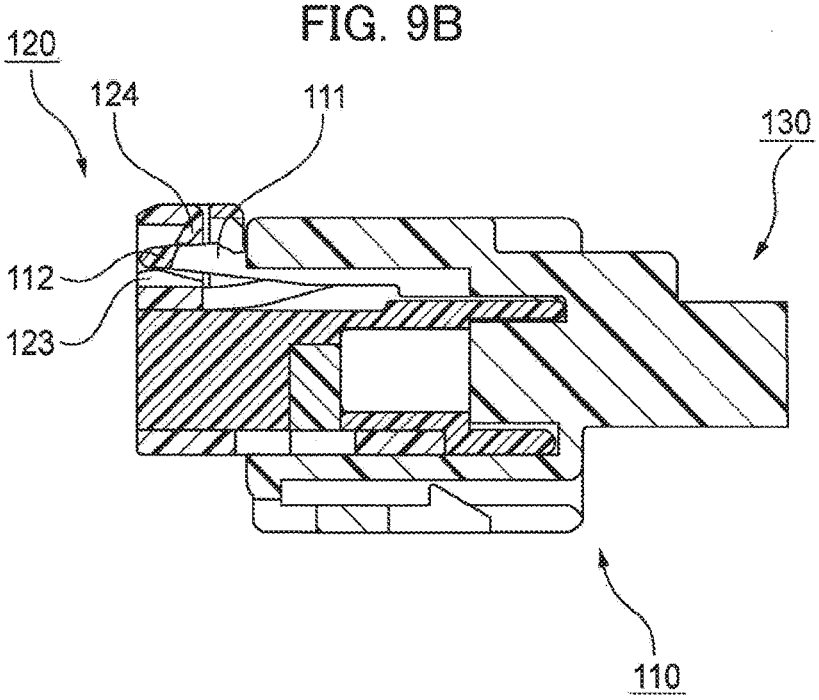
FIG. 9B is a cross-sectional view of the female housing and the fitting detection member, and the male housing in the state while the fitting is released (the state in which the engagement between the fitting detection member and the female housing is released), taken along line B-B of FIG. 4.

First, as illustrated in FIG. 9B, the fitting lock arm 111 of the female housing 110 is deflected downward so that the fitting detection member engaging part 112 of the female housing 110 and the engaging part 124 of the fitting detection member 120 of the connector 100 (see FIGS. 8A and 8B) of which the fitting is completed are separated from each other. Both the fitting detection member engaging part 112 and the male housing engaging part 113 that are provided at the fitting lock arm 111 move downward by the deflection.

At this time, since the fitting lock arm 111 abuts onto the deflection regulator 123 of the fitting detection member 120 located thereunder, a deflection amount of the fitting lock arm 111 is restricted. As a result of the restriction, as illustrated in FIG. 9B, the engagement between the fitting detection member engaging part 112 and the engaging part 124 is released, but as illustrated in FIG. 9A, the engagement between the engaging part 131 of the male housing 130 and the male housing engaging part 113 is not released. In other words, the deflection regulator 123 regulates the deflection amount of the fitting lock arm 111 to be in a range in which the engagement of the male housing engaging part 113 cannot be released while the engagement of the fitting detection member engaging part 112 can be released. Therefore, at this point in time, the female housing 110 and the male housing 130 cannot be separated from each other.

Figure 10A:
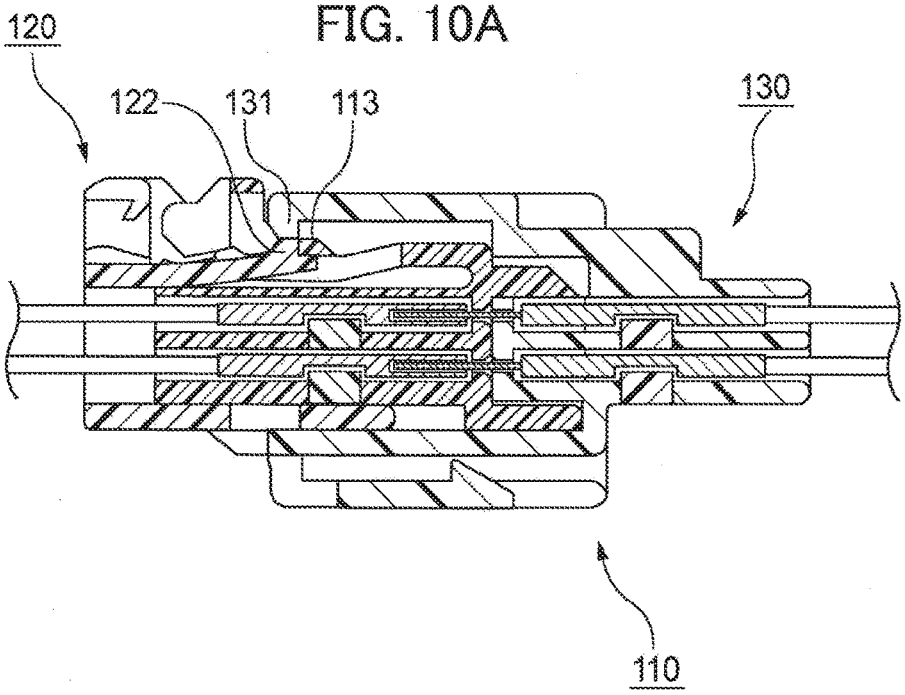
FIG. 10A is a cross-sectional view of the female housing and the fitting detection member, and the male housing in a state while the fitting is released (a state in which the fitting detection member returns to the temporary engagement position), taken along line A-A of FIG. 4.
Figure 10B:
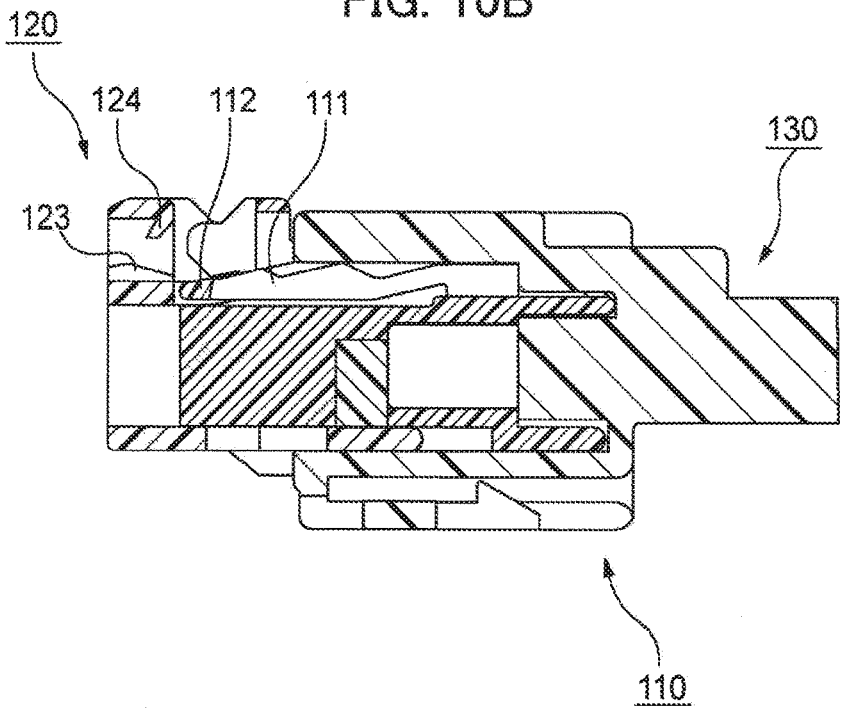
FIG. 10B is a cross-sectional view of the female housing and the fitting detection member, and the male housing in the state while the fitting is released (the state in which the fitting detection member returns to the temporary engagement position), taken along line B-B of FIG. 4.

Next, as illustrated in FIG. 10A, if the fitting detection member 120 in a state of FIG. 9A is pulled to be far away from the male housing 130, a rear wall surface of the detection protrusion 122 of the fitting detection member 120 is inclined with respect to the fitted direction, such that the detection protrusion 122 moves to pass under the male housing engaging part 113 of the female housing 110. That is, the fitting detection member 120 moves from the complete engagement position toward the temporary engagement position. As a result, as illustrated in FIG. 10B, the deflection regulator 123 moves rearward along with the fitting detection member 120, such that the fitting lock arm 111 of the female housing 110 becomes far away from the deflection regulator 123. Therefore, the regulation of the deflection amount of the fitting lock arm 111 is released, such that the fitting lock arm 111 can be further deflected downward.

In this state, if the fitting lock arm 111 is further deflected downward, as illustrated in FIG. 10A, the male housing engaging part 113 moves downward beyond the engaging part 131 of the male housing 130, such that the engagement between the male housing engaging part 113 and the engaging part 131 is released. In other words, the female housing 110 and the male housing 130 are in a state in which they can be separated from each other. In this state, if the fitting detection member 120 and the female housing 110 move rearward, the female housing 110 and the male housing 130 are separated from each other (return to the state illustrated in FIGS. 5A and 5B).

As described above, the fitting between the female housing 110 and the male housing 130 starts to be released (separated) in a state in which the fitting detection member 120 is at the complete engagement position to deflect the fitting lock arm 111, thereby releasing the engagement between the fitting detection member 120 and the female housing 110 (engagement between the fitting detection member engaging part 112 and the engaging part 124) and then moving the fitting detection member 120 toward the temporary engagement position. In this state, the fitting lock arm 111 is further deflected to release the engagement between the female housing 110 and the male housing 130. In other words, when the fitting of the connector 100 is released, two operations of releasing (first releasing) the engagement between the fitting detection member 120 and the female housing 110 and releasing (second releasing) the engagement between the female housing 110 and the male housing 130 are performed. Therefore, in the connector 100, the unintentional release of the fitting of the connector can be more certainly prevented, as compared with the conventional connector.

In addition, since a deflection direction of the fitting lock arm 111 for releasing the engagement of the fitting detection member engaging part 112 and a deflection direction of the fitting lock arm 111 for releasing the engagement of the male housing engaging part 113 are the same as each other (for example, a downward direction in FIGS. 9A and 9B), a series of operations of performing the above-mentioned first releasing, the movement of the fitting detection member 120 toward the temporary engagement position, and the above-mentioned second releasing can be continuously performed just like a single operation. Therefore, in the connector 100, the unintentional release of the fitting of the connector can be prevented, and the fitting of the connector can be easily released when the fitting of the connector is intentionally released.

Second Embodiment

Hereinafter, a connector (hereinafter, referred to as a 'connector' 200) according to a second embodiment of the present disclosure will be described with reference to FIGS. 11 to 17B. The connector 200 mainly differs from the connector 100 according to the first embodiment in a structure for engaging between a fitting detection member and a female housing. Therefore, the difference will be mainly described in detail below, and in connection with the connector 200, a description of portions having substantially the same functions and structures as those of the connector 100 will be omitted properly.

Structure of Connector

As illustrated in FIGS. 11 to 17B (particularly, FIGS. 15A and 15B), the connector 200 includes a female housing (first housing) 210, a fitting detection member 220, and a male housing (second housing) 230, like the connector 100.

Figure 11:
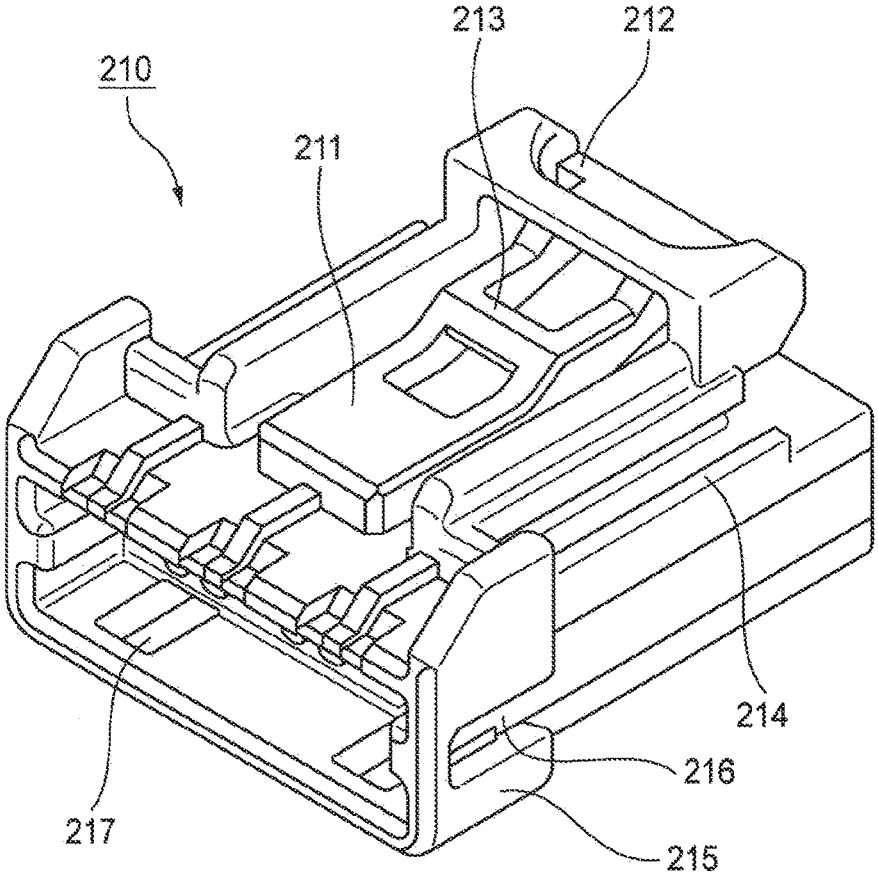
FIG. 11 is a schematic perspective view of a female housing according to a second embodiment of the present disclosure.

As illustrated in FIG. 11, a female housing 210 has a tubular shape, and includes a fitting lock arm 211, fitting detection member engaging parts (first locking parts) 212, a male housing engaging part (second locking part) 213, guide rails 214, abutting walls 215, side wall groove portions 216, and lower wall groove portions 217.

Figure 12:
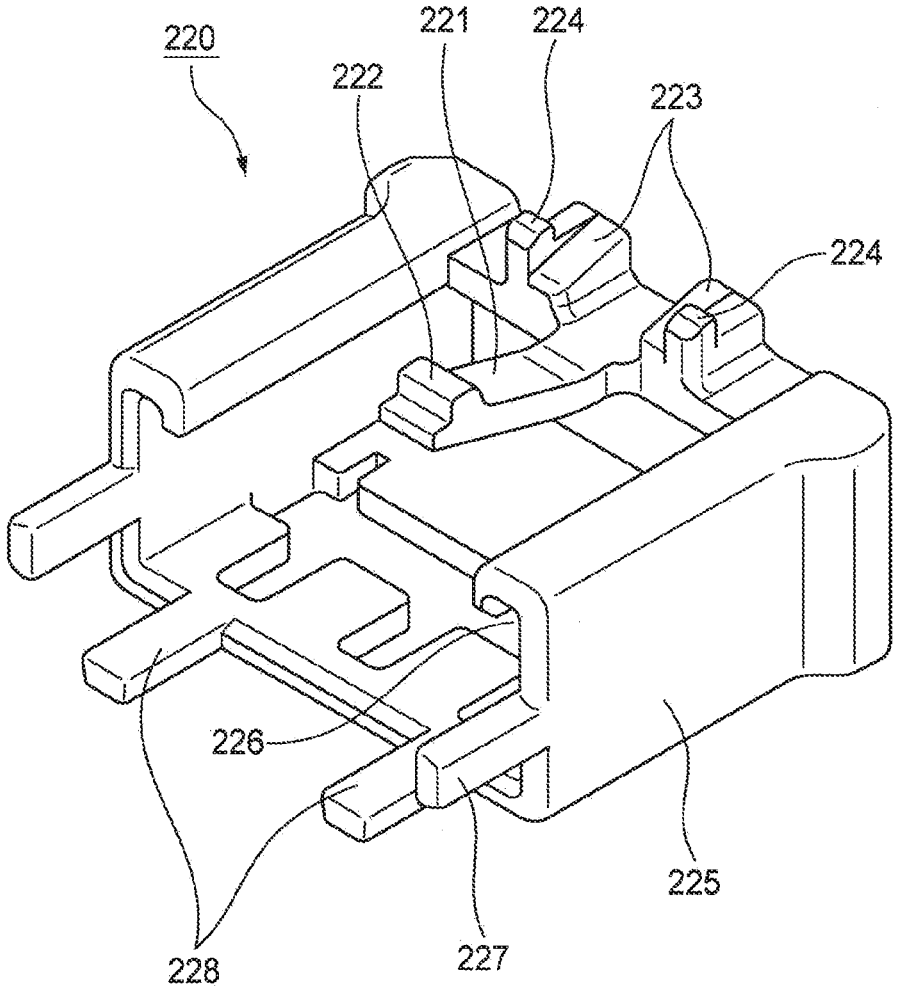
FIG. 12 is a schematic perspective view of a fitting detection member according to the second embodiment.

As illustrated in FIG. 12, the fitting detection member 220 has a ring shape and includes a detection lock arm 221, a detection protrusion 222, deflection regulators 223, engaging parts (first locked parts) 224, abutting walls 225, insertion holes 226, side wall protrusions 227, and lower wall protrusions 228. The engaging part 224 of the fitting detection member 220 has a protruding shape protruding upward, unlike the fitting detection member 120 (having a shape protruding downward) of the first embodiment.

Figure 13:
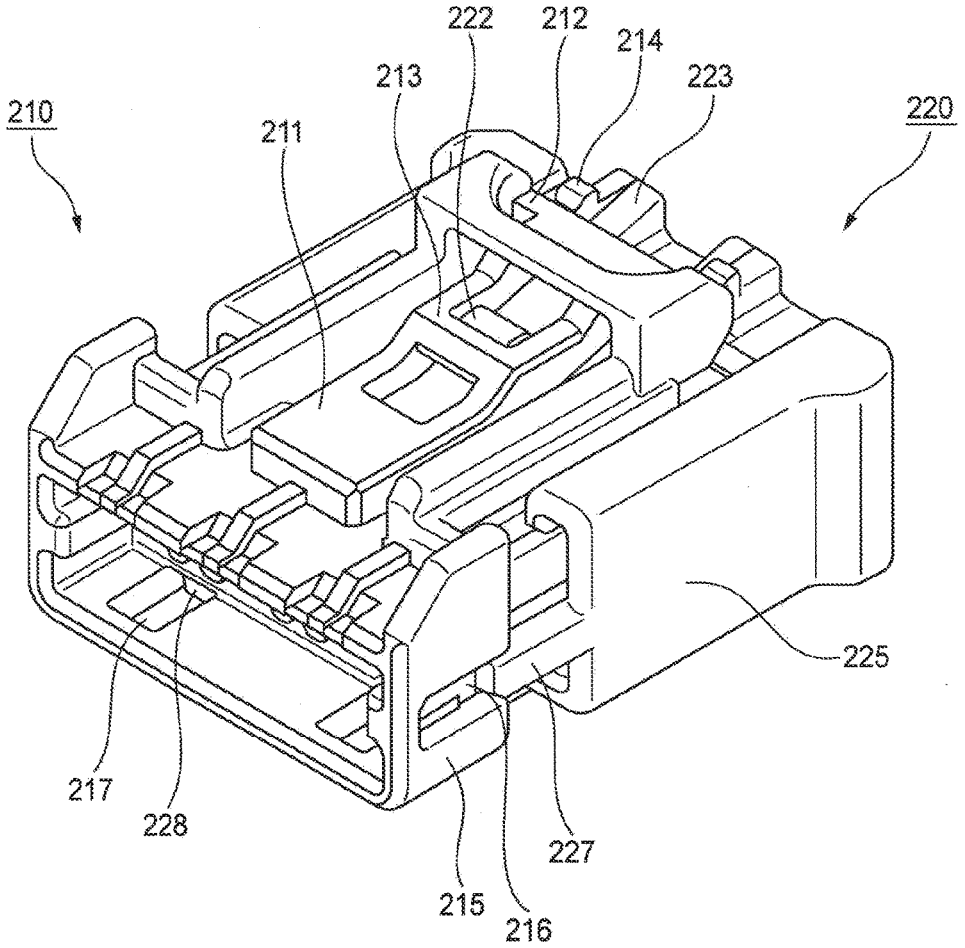
FIG. 13 is a schematic perspective view of a case in which the fitting detection member of FIG. 12 is mounted to the female housing of FIG. 11 (a case in which the fitting detection member is at a temporary engagement position).

As illustrated in FIG. 13, the fitting detection member 220 is inserted onto the female housing 210 from a rear of the female housing 210. The detection protrusion 222 of the fitting detection member 220 abuts onto a rear wall surface of the male housing engaging part 213 of the female housing 210, such that a forward movement of the fitting detection member 220 is restricted. A position of the fitting detection member 220 illustrated in FIG. 13 is also referred to as a 'temporary engagement position' like the first embodiment.

Figure 14:
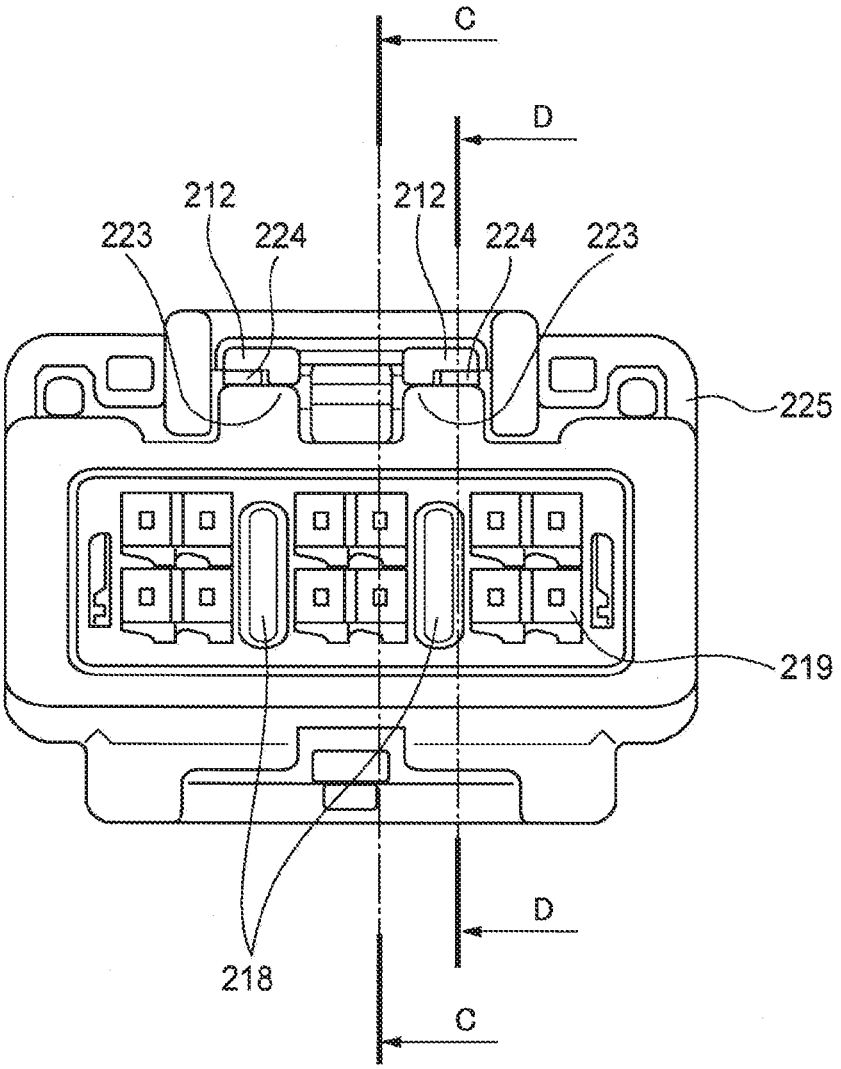
FIG. 14 is a rear view of the female housing and the fitting detection member of FIG. 13 viewed from a rear in a fitted direction.

As illustrated in FIG. 14, the female housing 210 has inner walls 218 that connect a lower wall and an upper wall thereof to each other, and has a plurality of terminal housing chambers 219 within areas divided by the inner walls 218. It should be noted that FIG. 14 illustrates a state in which the terminal housing chambers 219 do not house terminals, like the first embodiment.

Fitting of Connector

Figure 15A:
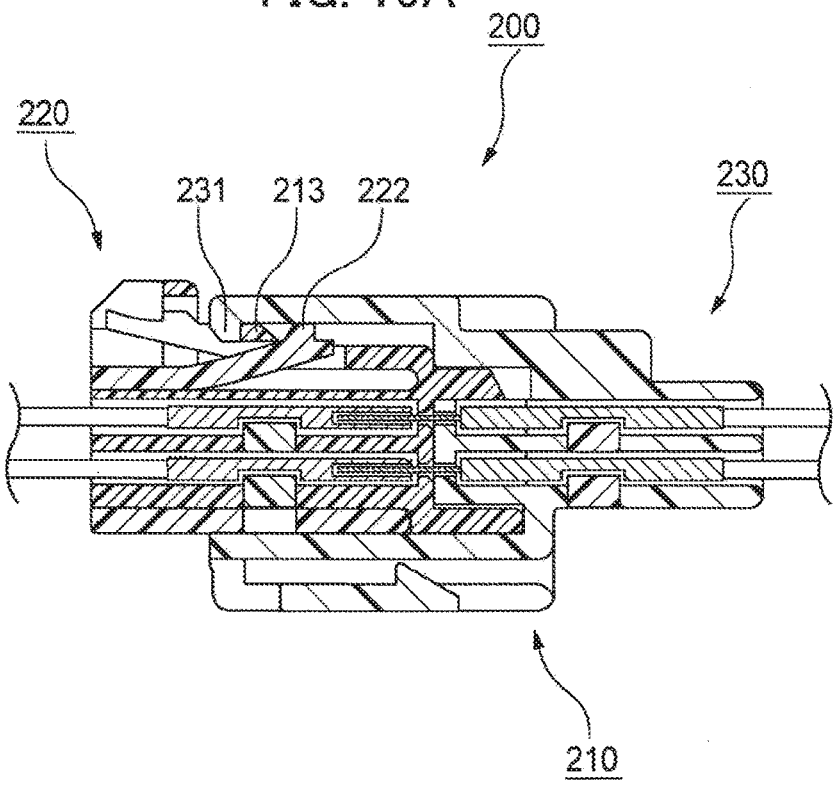
FIG. 15A is a cross-sectional view of the female housing and the fitting detection member, and a male housing of a connector according to the second embodiment in a state in which fitting of the female housing and the fitting detection member with the male housing is completed (a state in which the fitting detection member is at a complete engagement position), taken along line C-C of FIG. 14.

As illustrated in FIG. 15A, when fitting of the connector 200 is completed (when the fitting detection member 220 is at a complete engagement position), the male housing engaging part 213 provided at the fitting lock arm 211 of the female housing 210 and an engaging part (second locked part) 231 of the male housing 230 are engaged with each other. At this time, as illustrated in FIG. 15B, the fitting detection member engaging part 212 provided at the fitting lock arm 211 of the female housing 210 and the engaging part 224 of the fitting detection member 220 are engaged with each other.

Figure 15B:
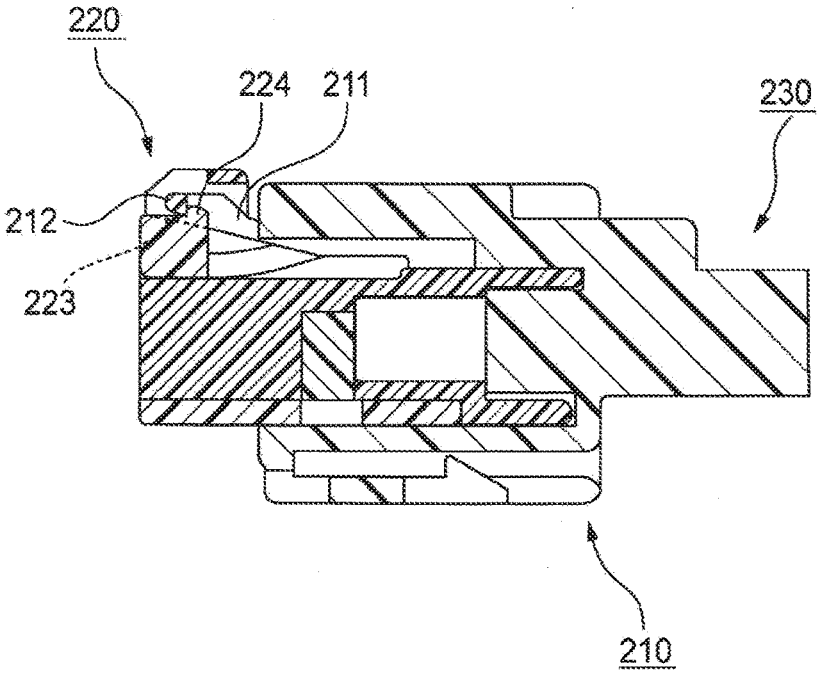
FIG. 15B is a cross-sectional view of the female housing and the fitting detection member, and the male housing of the connector according to the second embodiment in the state in which the fitting of the female housing and the fitting detection member with the male housing is completed (the state in which the fitting detection member is at the complete engagement position), taken along line D-D of FIG. 14.

In more detail, as illustrated in FIG. 15B, the fitting detection member engaging part 212 of the female housing 210 moves to climb over the engaging part 224 of the fitting detection member 220 to be thus engaged with the engaging part 224. For this reason, unlike the first embodiment, in procedures of releasing the fitting of the connector 200 to be described below, a deflection direction of the fitting lock arm 211 for releasing engagement of the fitting detection member engaging part 212 and a deflection direction of the fitting lock arm 211 for releasing engagement of the male housing engaging part 213 is opposite to each other.

Release of Fitting of Connector

Figure 16A:
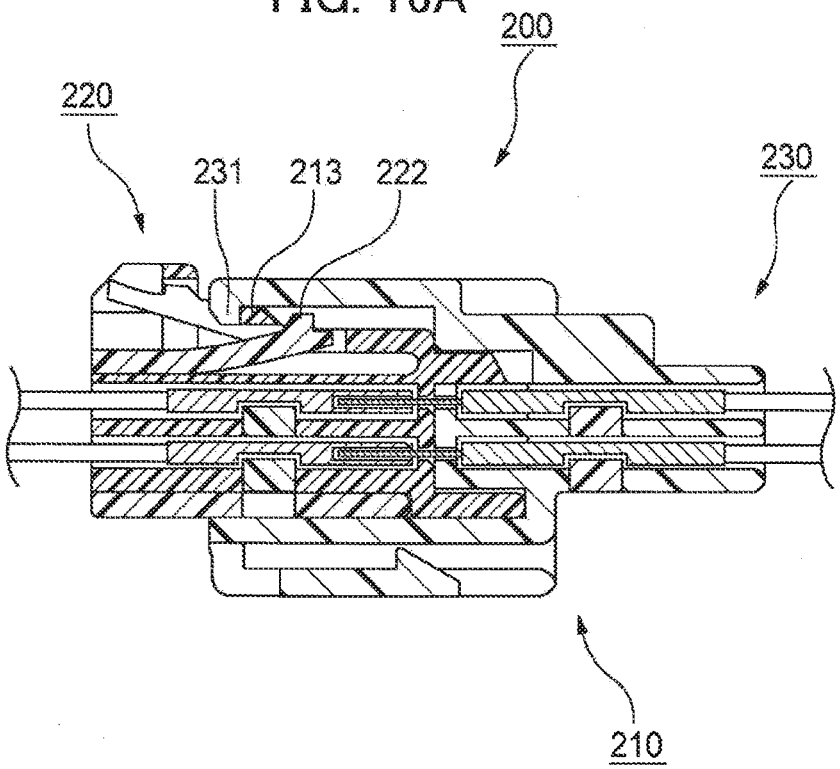
FIG. 16A is a cross-sectional view of the female housing and the fitting detection member, and the male housing in a state while the fitting is released (a state in which engagement between the fitting detection member and the female housing is released), taken along line C-C of FIG. 14.
Figure 16B:
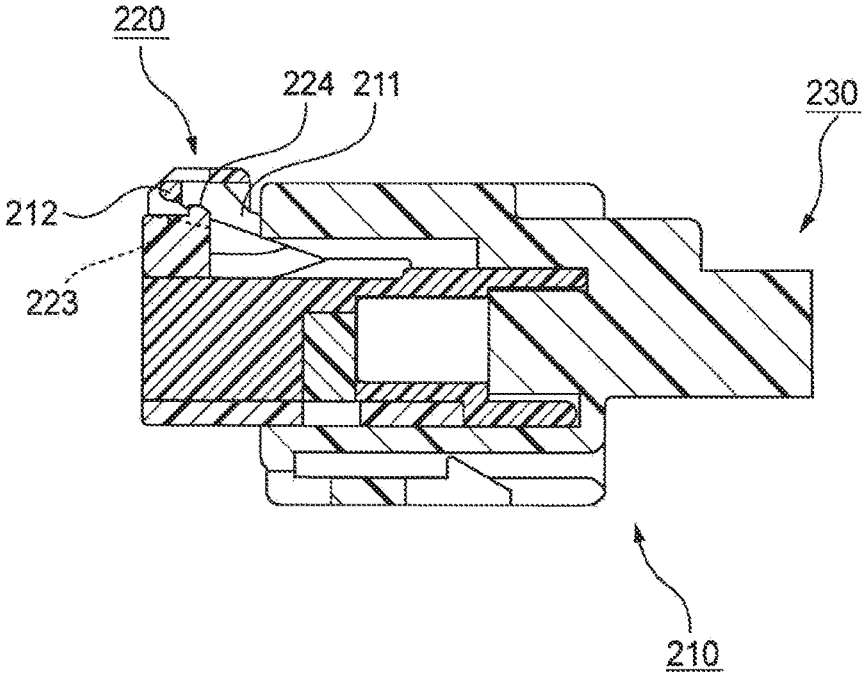
FIG. 16B is a cross-sectional view of the female housing and the fitting detection member, and the male housing in the state while the fitting is released (the state in which the engagement between the fitting detection member and the female housing is released), taken along line D-D of FIG. 14.

When the fitting of the connector 200 is released, the fitting lock arm 211 of the female housing 210 is first deflected upward so that the fitting detection member engaging part 212 of the female housing 210 and the engaging part 224 of the fitting detection member 220 of the connector 200 (see FIGS. 15A and 15B) of which the fitting is completed are separated from each other, as illustrated in FIG. 16B. The fitting detection member engaging part 212 provided at the fitting lock arm 211 moves upward by the deflection.

At this time, since the deflection direction (an upward direction) of the fitting lock arm 211 is opposite to a deflection direction (a downward direction) in which engagement between the male housing engaging part 213 of the female housing 210 and the engaging part 231 of the male housing 230 is released, engagement between the fitting detection member engaging part 212 and the engaging part 224 is released, but as illustrated in FIG. 16A, the engagement between the engaging part 231 of the male housing 230 and the male housing engaging part 213 is not released. In other words, the deflection regulator 223 regulates a deflection amount of the fitting lock arm 211 to be in a range in which the engagement of the male housing engaging part 213 cannot be released while the engagement of the fitting detection member engaging part 212 can be released. As a result, at this point in time, the female housing 210 and the male housing 230 cannot be separated from each other.

Figure 17A:
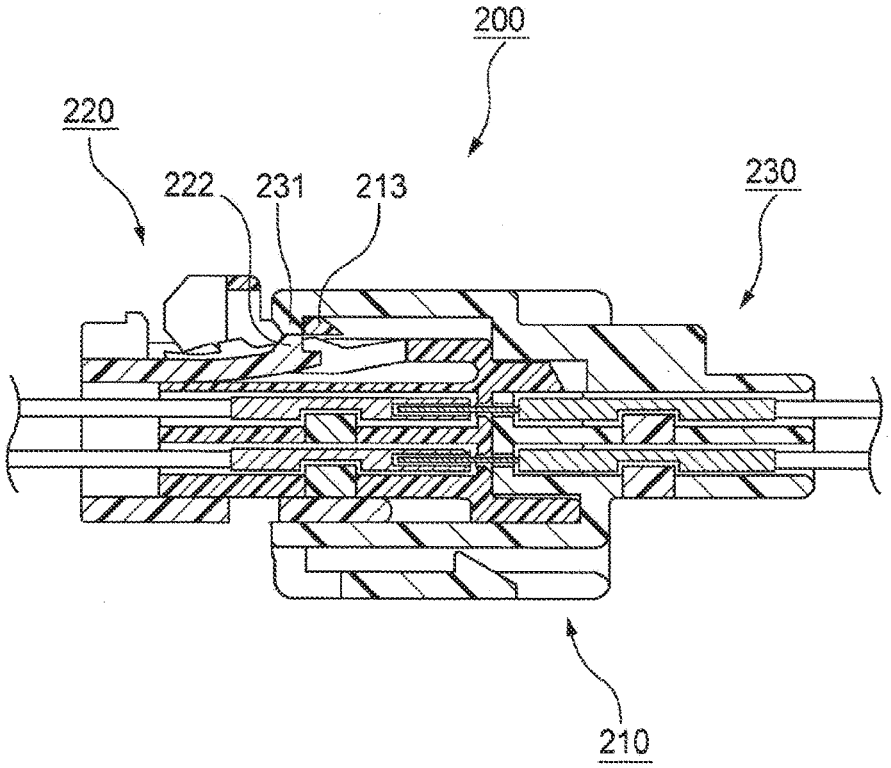
FIG. 17A is a cross-sectional view of the female housing and the fitting detection member, and the male housing in a state while the fitting is released (a state in which the fitting detection member returns to the temporary engagement position), taken along line C-C of FIG. 14.
Figure 17B:
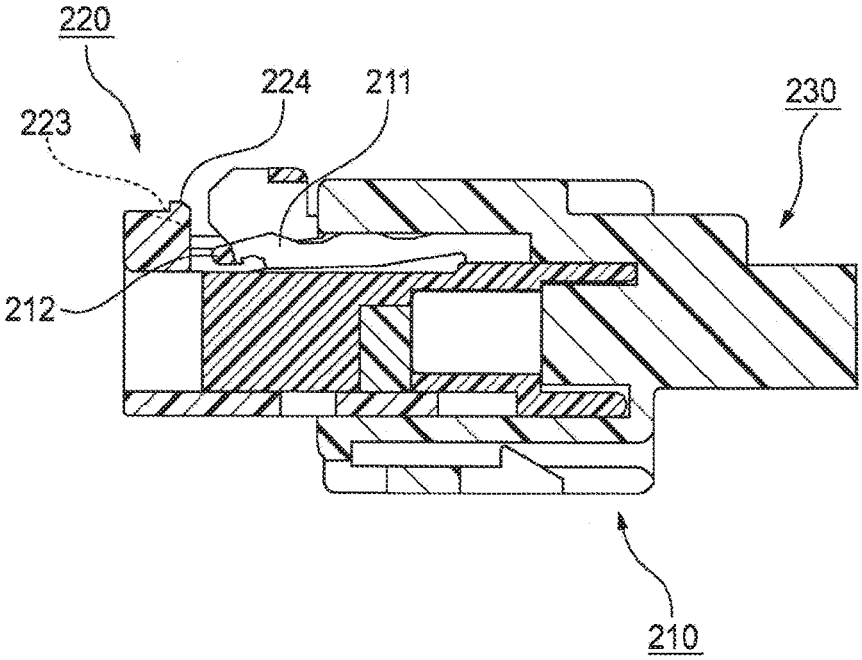
FIG. 17B is a cross-sectional view of the female housing and the fitting detection member, and the male housing in the state while the fitting is released (the state in which the fitting detection member returns to the temporary engagement position), taken along line D-D of FIG. 14.

Next, as illustrated in FIG. 17A, if the fitting detection member 220 in a state of FIG. 16A is pulled to be far away from the male housing 230, a rear wall surface of the detection protrusion 222 of the fitting detection member 220 is inclined with respect to a fitted direction, such that the detection protrusion 222 moves to pass under the male housing engaging part 213 of the female housing 210. That is, the fitting detection member 220 moves from the complete engagement position toward the temporary engagement position. As a result, as illustrated in FIG. 17B, the deflection regulator 223 moves rearward along with the fitting detection member 220, such that the fitting lock arm 211 of the female housing 210 becomes far away from the deflection regulator 223. Therefore, the regulation of the deflection amount of the fitting lock arm 211 is released, such that the fitting lock arm 211 can be deflected downward.

In this state, if the fitting lock arm 211 is deflected downward, as illustrated in FIG. 17A, the male housing engaging part 213 moves downward beyond the engaging part 231 of the male housing 230, such that the engagement between the male housing engaging part 213 and the engaging part 231 is released. In other words, the female housing 210 and the male housing 230 are in a state in which they can be separated from each other. In this state, if the fitting detection member 220 and the female housing 210 move rearward, the female housing 210 and the male housing 230 are separated from each other.

As described above, the fitting between the female housing 210 and the male housing 230 starts to released (separated) in a state in which the fitting detection member 220 is at the complete engagement position to deflect the fitting lock arm 211 upward, thereby releasing the engagement between the fitting detection member 220 and the female housing 210 (engagement between the fitting detection member engaging part 212 and the engaging part 224) and then moving the fitting detection member 220 from the complete engagement position toward the temporary engagement position. In this state, the fitting lock arm 211 is deflected downward to release the engagement between the female housing 210 and the male housing 230. In other words, when the fitting of the connector 200 is released, two operations of releasing (first releasing) the engagement between the fitting detection member 220 and the female housing 210 and releasing (second releasing) the engagement between the female housing 210 and the male housing 230 are performed. Therefore, in the connector 200, the unintentional release of the fitting of the connector can be more certainly prevented, as compared with the conventional connector.

Furthermore since the deflection direction of the fitting lock arm 211 for releasing the engagement of the fitting detection member engaging part 212 and the deflection direction of the fitting lock arm 211 for releasing the engagement of the male housing engaging part 213 are opposite to each other (for example, an upward direction in FIGS. 16A and 16B and a downward direction in FIGS. 17A and 17B), the fitting lock arm 211 is deflected in the former direction to move the fitting detection member 220 toward the temporary engagement position simultaneously with performing the first releasing, and the fitting lock arm 211 is then deflected in the latter direction to perform the second releasing. That is, a series of operations are performed while changing the deflection direction of the fitting lock arm 211. Therefore, in the connector 200, an operation of releasing the fitting of the connector is somewhat complicated, but unintentional release of the fitting of the connector can be more certainly prevented due to the complicated operation.

Here, the respective features of the embodiments of the connector according to the present disclosure described above are simply arranged in the following 1) to 5).

1) A connector (100, 200) includes: a first housing (110, 210) capable of housing a terminal (141); a second housing (130, 230) capable of housing a mating terminal (161); and a fitting detection member (120, 220) capable of detecting a fitted state between the first housing (110, 210) and the second housing (130, 230). The first housing (110, 210) includes: a fitting lock arm (111, 211) extending toward a rear in a fitting direction; a first locking part (112, 212) provided in the fitting lock arm (111, 211) and engageable with the fitting detection member (120, 220); and a second locking part (113, 213) provided in the fitting lock arm (111, 211) and engageable with the second housing (130, 230). The fitting detection member (120, 220) includes: a detection lock arm (121, 221) extending toward a front in the fitting direction; a detection protrusion (122, 222) provided in the detection lock arm (121, 221); a deflection regulator (123, 223) capable of regulating a deflection amount of the fitting lock arm (111, 211); and a first locked part (124, 224) corresponding to the first locking part (112, 212). The second housing (130, 230) includes a second locked part (131, 231) corresponding to the second locking part (113, 213). When the connector (100, 200) is fitted, the fitting detection member (120, 220) is mounted to the first housing (110, 210) from the rear of the fitting direction and moved from a temporary engagement position to a complete engagement position. The temporary engagement position is at which the detection protrusion (122, 222) is in contact with the second locking part (113, 213) and a movement of the fitting detection member (120, 220) toward the front in the fitting direction is prevented. The complete engagement position is at which the contact of the detection protrusion (122, 222) with the second locking part (113, 213) is released by the second locked part (131, 231) engaged with the second locking part (113, 213) and the fitting detection member (120, 220) moves toward the front in the fitting direction and at which the first locked part (124, 224) is engaged with the first locking part (112, 212). When the fitting detection member (120, 220) is located at the complete engagement position, the deflection regulator (123, 223) regulates the deflection amount of the fitting lock arm (111, 211) within a range in which an engagement between the second locking part (113, 213) and the second locked part (131, 231) is unreleasable while an engagement between the first locking part (112, 212) and the first locked part (124, 224) is releasable.

2) In the connector (100) of above 1), a deflection direction of the fitting lock arm (111) for releasing the engagement between the first locking part (112) and the first locked part (124) and a deflection direction of the fitting lock arm (111) for releasing the engagement between the second locking part (113) and the second locked part (131) are a same direction, and when the fitting detection member (120) is located at the complete engagement position, the deflection regulator (123) exists in a position where the deflection regulator (123) interferes with the fitting lock arm (111) when the fitting lock arm (111) is deflected in the same direction.

3) In the connector (200) of above 1), a deflection direction of the fitting lock arm (211) for releasing the engagement between the first locking part (212) and the first locked part (224) and a deflection direction of the fitting lock arm (211) for releasing the engagement between the second locking part (213) and the second locked part (231) are opposite to each other, and when the fitting detection member (220) is located at the complete engagement position, the deflection regulator (223) exists in a position where the deflection regulator (223) interferes with the fitting lock arm (211) when the fitting lock arm (211) is deflected in the deflection direction for releasing the engagement between the second locking part (213) and the second locked part (231).

4) In the connector (100, 200) of any one of above 1) to 3) the fitting detection member (120) is inserted onto the first housing (110).

5) In the connector (100, 200) of any one of above 1) to 4), the first locking part (112) is located at an end of a free end side of the fitting lock arm (111), and the second locking part (113) is located at a position closer to a fixed end than the first locking part (112) of the fitting lock arm (111).

Embodiments of the present invention have been described above. However, the invention may be embodied in other specific forms without departing from the spirit or essential characteristics thereof. The present embodiments are therefore to be considered in ail respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connector comprising:

a first housing configured to house a terminal;

a second housing configured to house a mating terminal and fittable with the first housing; and a fitting detection member mounted from a rear of the first housing in a first direction in which the first housing approaches the second housing in a fitted direction between the first housing and the second housing, the fitting detection member being configured to detect a fitted state between the first housing and the second housing, wherein the first housing comprises:

a fitting lock arm extending toward a second direction opposite to the first direction;

a first locking part provided in the fitting lock arm and engageable with the fitting detection member; and a second locking part provided in the fitting lock arm and engageable with the second housing, the fitting detection member comprises:

a detection lock arm extending toward the first direction;

a detection protrusion provided in the detection lock arm;

a deflection regulator configured to regulate a deflection amount of the fitting lock arm; and a first locked part engageable with the first locking part, the second housing comprises a second locked part engageable with the second locking part, the fitting detection member is movable between a temporary engagement position and a complete engagement position, the temporary engagement position at which a contact between the detection protrusion and the second locking part prevents a movement of the fitting detection member in the first direction, the complete engagement position to which the fitting detection member moves from the temporary engagement position in the first direction and at which the first locked part is engaged with the first locking part, the second locked part engaged with the second locking part releases the contact between the detection protrusion and the second locking part located at the temporary engagement position and allows the fitting detection member to move in the first direction, and the deflection regulator of the fitting detection member located at the complete engagement position regulates the deflection amount of the fitting lock arm within a range in which an engagement between the second locking part and the second locked part is unreleasable while an engagement between the first locking part and the first locked part is releasable.

2. The connector of claim 1, wherein a deflection direction of the fitting lock arm for releasing the engagement between the first locking part and the first locked part and a deflection direction of the fitting lock arm for releasing the engagement between the second locking part and the second locked part are a same direction, and the deflection regulator of the fitting detection member located at the complete engagement position interferes with the fitting lock arm deflected in the same direction.

3. The connector of claim 1, wherein a deflection direction of the fitting lock arm for releasing the engagement between the first locking part and the first locked part and a deflection direction of the fitting lock arm for releasing the engagement between the second locking part and the second locked part are opposite to each other, and the deflection regulator of the fitting detection member located at the complete engagement position interferes with the fitting lock arm deflected in the deflection direction for releasing the engagement between the second locking part and the second locked part.

4. The connector of claim 1, wherein the fitting detection member is inserted onto the first housing.

5. The connector of claim 1, wherein the first locking part is located at an end of a free end side of the fitting lock arm, and the second locking part is located at a position closer to a fixed end than the first locking part of the fitting lock arm.

* * * * *